US009999312B2

(12) United States Patent
Taylor

(10) Patent No.: US 9,999,312 B2
(45) Date of Patent: Jun. 19, 2018

(54) WINDOW TREATMENT SECUREMENT DEVICE

(71) Applicant: Victoria Catherine Taylor, Spring Hill, TN (US)

(72) Inventor: Victoria Catherine Taylor, Spring Hill, TN (US)

( * ) Notice: Subject to any disclaimer, the term of this patent is extended or adjusted under 35 U.S.C. 154(b) by 0 days. days.

(21) Appl. No.: 15/212,198

(22) Filed: Jul. 16, 2016

(65) Prior Publication Data

US 2017/0027362 A1 Feb. 2, 2017

Related U.S. Application Data

(60) Provisional application No. 62/199,624, filed on Jul. 31, 2015.

(51) Int. Cl.
*A47H 1/14* (2006.01)
*A47H 1/08* (2006.01)
*A47H 1/144* (2006.01)

(52) U.S. Cl.
CPC ..... *A47H 1/08* (2013.01); *A47H 1/144* (2013.01)

(58) Field of Classification Search
CPC ..... Y10T 16/35; Y10T 16/353; Y10T 16/354; A47H 1/022; A47H 1/08; A47H 1/102; A47H 1/104; A47H 1/142; A47H 1/144
USPC ..... 211/105.1, 105.3, 105.5, 87.01; 248/200.1, 208, 216.4, 214, 251, 252, 248/257, 259, 261, 262, 264, 265, 268, 248/269, 271, 351, 354.1
See application file for complete search history.

(56) References Cited

U.S. PATENT DOCUMENTS 544,899 A * 8/1895 Mohr ..... A47H 1/13 248/252
909,975 A * 1/1909 Washburn ..... A47H 1/13 248/252
1,066,157 A * 7/1913 Shorkey ..... A47H 1/13 248/252
1,103,982 A * 7/1914 Moore ..... A47H 1/13 248/252
1,259,922 A * 3/1918 Starr ..... A47H 1/18 211/105.5
1,299,556 A * 4/1919 Crecelius ..... A47H 1/022 211/105.3
1,384,246 A * 7/1921 Durnell ..... E06B 9/50 248/252
1,386,468 A * 8/1921 Goldner ..... E06B 9/50 248/268

(Continued)

*Primary Examiner* — Terrell L McKinnon
*Assistant Examiner* — Michael McDuffie
(74) *Attorney, Agent, or Firm* — PatentFile, LLC; Bradley C Fach; Steven R Kick

(57) ABSTRACT

In some embodiments a window treatment securement device may include a first elongated member having a first mounting plate. A first frame stake may be coupled to the first elongated member, and a first receiving slot may be coupled to the first mounting plate. The first elongated member may optionally be coupled to a second elongated member having a second mounting plate. A second frame stake may be coupled to the second elongated member, and a second receiving slot may be coupled to the second mounting plate. The device may be affixed to an object, such as walls and window trim, and a window treatment may be secured to the device thereby securing the window treatment to the object.

9 Claims, 8 Drawing Sheets

(56) References Cited

U.S. PATENT DOCUMENTS

| | | | | | |
|---|---|---|---|---|---|
| 1,391,528 | A | * | 9/1921 | Cranford | E06B 9/50 248/267 |
| 1,455,166 | A | * | 5/1923 | Hinderliter | E06B 9/50 248/266 |
| 1,518,441 | A | * | 12/1924 | Nowell | A47H 1/13 248/252 |
| 1,588,092 | A | * | 6/1926 | Campbell | E06B 9/50 248/259 |
| 1,837,046 | A | * | 12/1931 | Hirschberger | A47H 1/022 160/330 |
| 2,056,874 | A | * | 10/1936 | Updegraff | A47H 1/122 248/265 |
| 2,198,280 | A | * | 4/1940 | Culbertson | A47H 1/13 248/252 |
| 2,281,664 | A | * | 5/1942 | Bowser | A47H 1/122 248/259 |
| 2,415,751 | A | * | 2/1947 | Murn | A47H 1/122 248/259 |
| 4,140,294 | A | | 2/1979 | Zwarts | |
| 5,082,226 | A | * | 1/1992 | Mahan | A47H 1/102 248/253 |
| 6,595,478 | B2 | | 7/2003 | Lee | |
| 8,051,781 | B1 | * | 11/2011 | Vind | A47K 3/38 108/102 |
| 8,418,975 | B1 | | 4/2013 | Burr | |

* cited by examiner

WINDOW TREATMENT SECUREMENT DEVICE

CROSS REFERENCE TO RELATED APPLICATIONS

This application claims priority to and the benefit of the filing date of U.S. Provisional Application No. 62/199,624, filed on Jul. 31, 2015, entitled "CURTAIN ROD HOLDER", which is hereby incorporated by reference in its entirety.

FIELD OF THE INVENTION

This patent specification relates to the field of devices configured to secure window treatments and the like. More specifically, this patent specification relates to devices configured to secure window treatments and the like to substrates without damaging the substrates.

BACKGROUND

Window treatments, such as curtains, shades, blinds, valances, and the like, are commonly used for many aesthetic and functional purposes. These window treatments may also be used to cover or augment other structures such as doors, doorways, entrances, hallways, and may be secured to the structures or to substrates to which the structures may be supported or formed by. Currently, some methods and apparatuses for securing window treatments cause damage to substrates, like walls window trim, door trim, or to avoid damage, as one or more fasteners must be driven into the substrate. This damage is costly and time consuming to repair. Other methods and apparatuses which claim not to damage substrates, as is the case with tension rods, must be installed inside of the window which is usually not a desired effect. Additionally, tension rod apparatuses have a tendency to fall of a substrate and are often unable to support window treatments of larger weights.

Therefore, a need exists for novel window treatment attachment devices which are able to secure window treatments. Another need exists for novel window treatment attachment devices that are able to secure a plurality of different types of window treatments, such as curtains, shades, blinds, valances, and the like. There is a further need for novel window treatment attachment devices which do not cause damage to the substrates to which they are attached to. Finally, there exists a need for novel window treatment attachment devices that are able to support window treatments of larger weights.

BRIEF SUMMARY OF THE INVENTION

A window treatment securement device for securing window treatments to objects such as walls, window frames, window trim, doors, and other structural objects is provided. The device may be affixed to objects without the need to drill or otherwise insert fasteners into the objects. In this manner, the device may allow window treatments which are secured to the device to be affixed to an object without inserting fasteners into the object. In some embodiments, a window treatment securement device may include a first elongated member having a first mounting plate. A first frame stake may be coupled to the first elongated member, and a first receiving slot may be coupled to the first mounting plate. The first elongated member may optionally be coupled to a second elongated member having a second mounting plate. A second frame stake may be coupled to the second elongated member, and a second receiving slot may be coupled to the second mounting plate. A window treatment may be secured to one or more receiving slots of the device. The device may be affixed an object, such as walls and window trim, and a window treatment may be secured to the device thereby securing the window treatment to the object.

In further embodiments, a window treatment securement device may include a first elongated member having a first mounting plate. A first frame stake may be coupled to the first elongated member, and a first mounting aperture may be positioned on the first mounting plate. The first elongated member may optionally be coupled to a second elongated member having a second mounting plate. A second frame stake may be coupled to the second elongated member, and a second mounting aperture may be positioned on the second mounting plate. A window treatment may be secured to one or more mounting apertures of the device. The device may be affixed an object, such as walls and window trim, and a window treatment may be secured to the device thereby securing the window treatment to the object.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
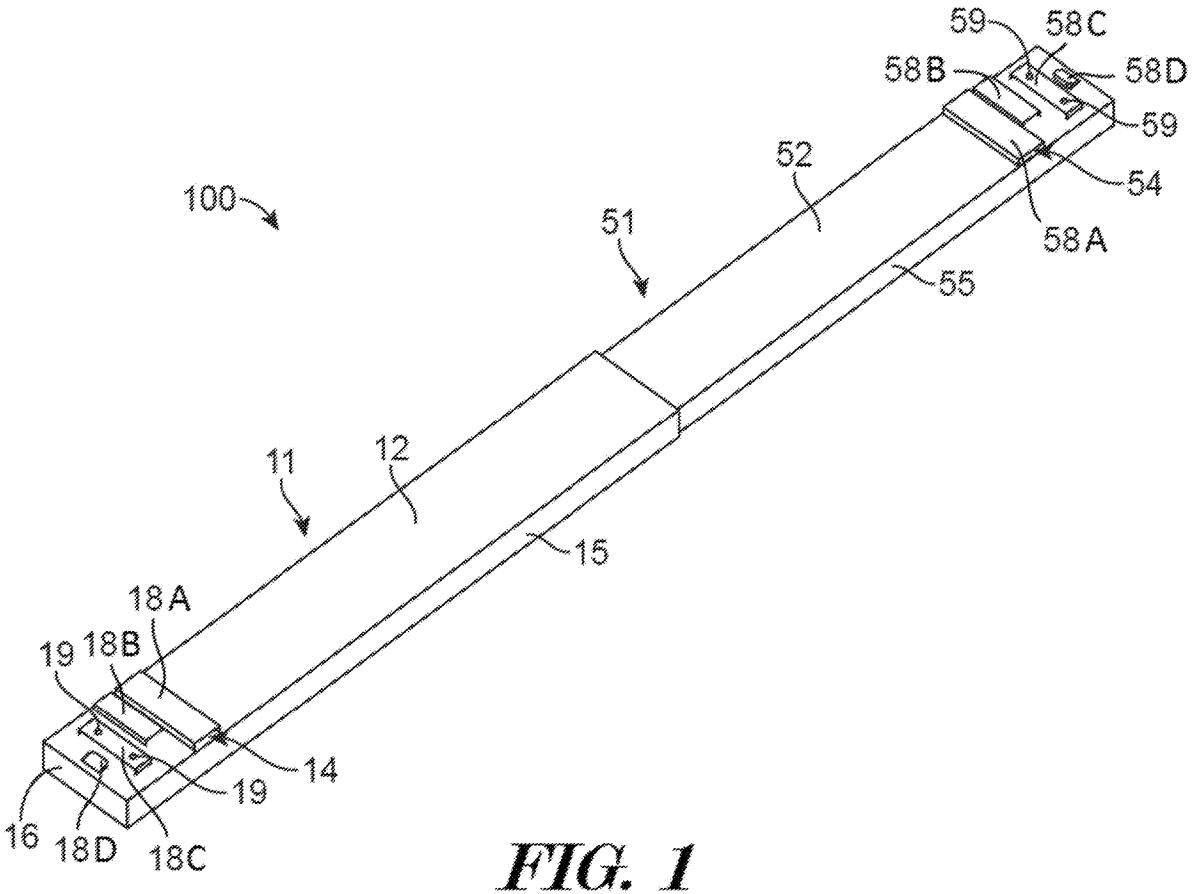
FIG. 1—FIG. 1 depicts a front perspective view of an example of a window treatment securement device according to various embodiments described herein.
Figure 3:
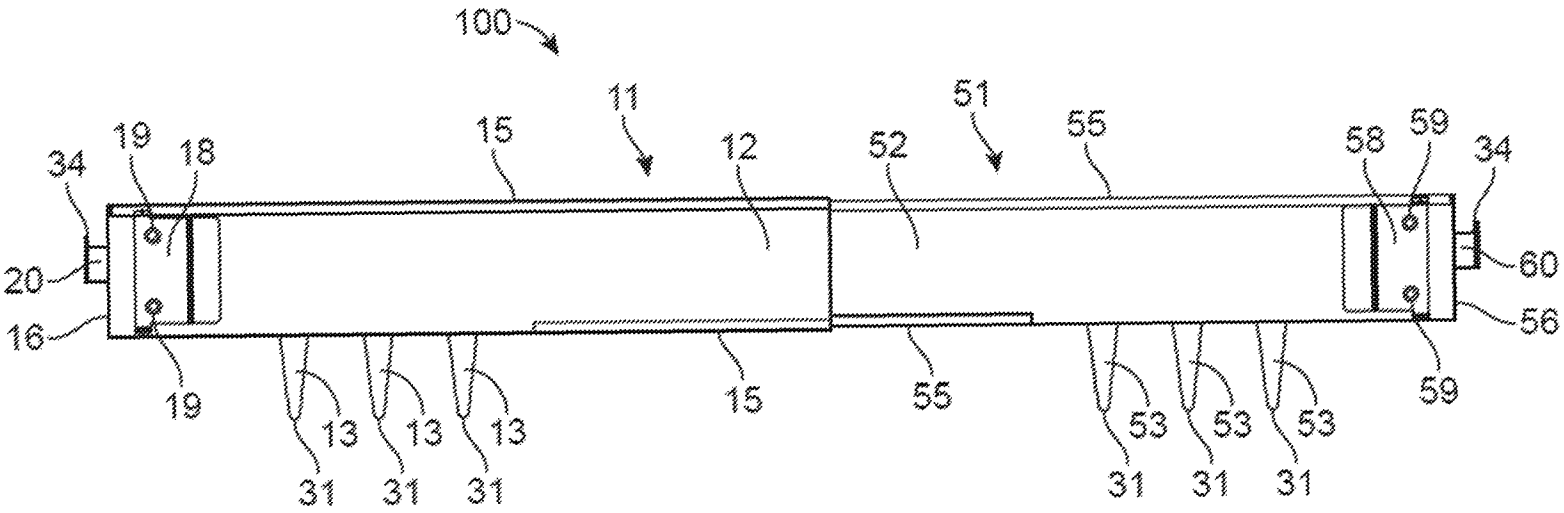
FIG. 3—FIG. 3 shows a front elevation view of an alternative example of a window treatment securement device according to various embodiments described herein.
Figure 4:
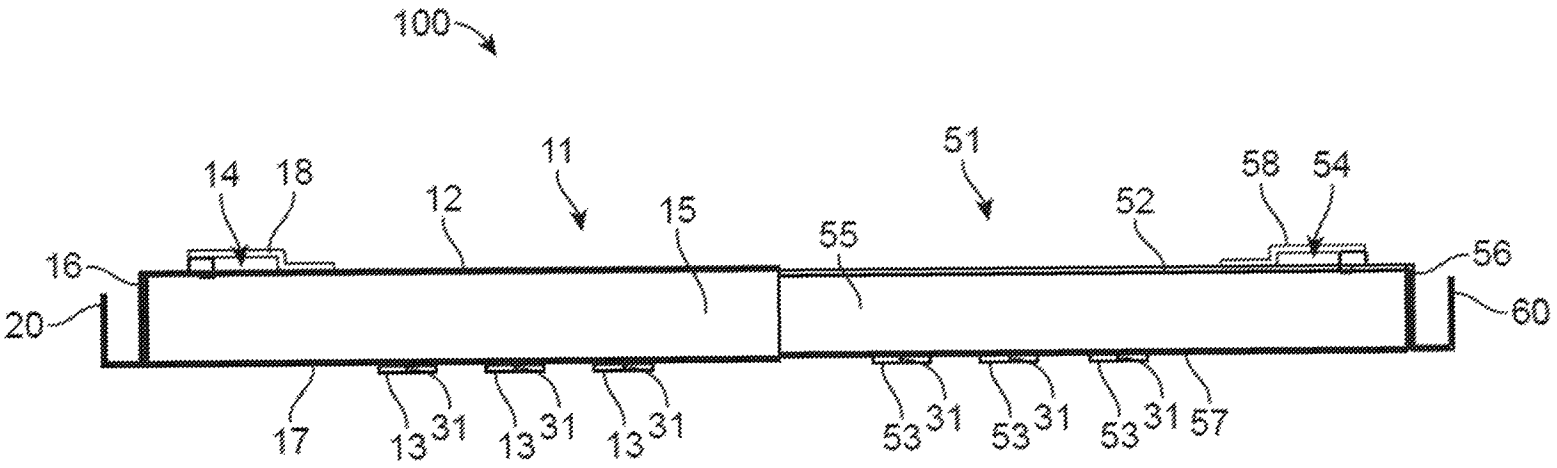
FIG. 4—FIG. 4 depicts a bottom plan view of an alternative example of a window treatment securement device according to various embodiments described herein.
Figure 5:
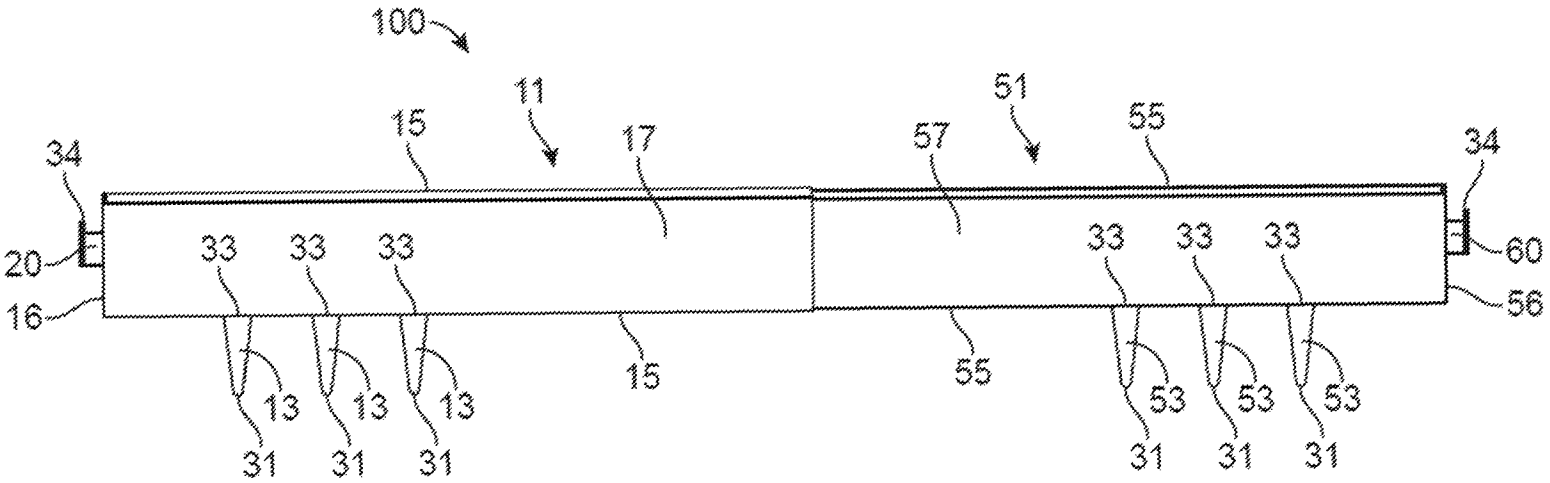
FIG. 5—FIG. 5 illustrates a rear elevation view of an alternative example of a window treatment securement device according to various embodiments described herein.
Figure 6:
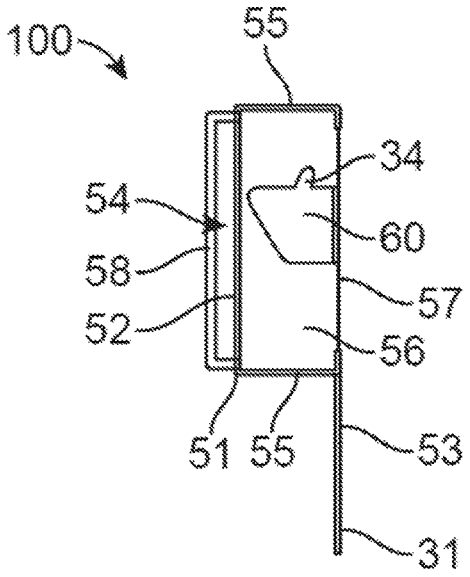
FIG. 6—FIG. 6 shows a right side elevation view of an alternative example of a window treatment securement device according to various embodiments described herein.
Figure 7:
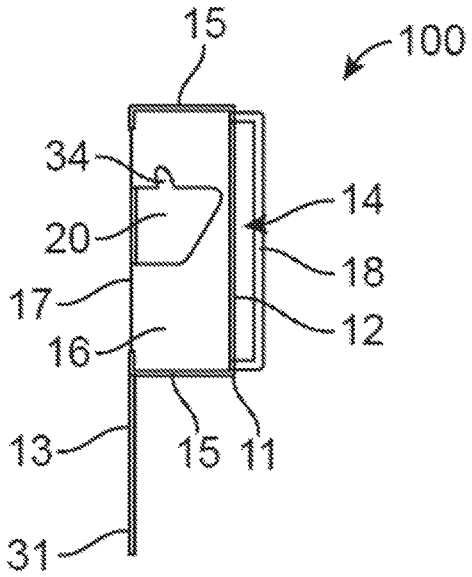
FIG. 7—FIG. 7 depicts a left side elevation view of an alternative example of a window treatment securement device according to various embodiments described herein.

For purposes of description herein, the terms "upper", "lower", "left", "right", "rear", "front", "side", "vertical", "horizontal", and derivatives thereof shall relate to the invention as oriented in FIG. 1 and FIG. 3. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions, orientation descriptive terms, and other physical characteristics relating to the embodiments disclosed herein are not to be considered as limiting, unless the claims expressly state otherwise.

New devices configured to secure window treatments and the like are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 2:
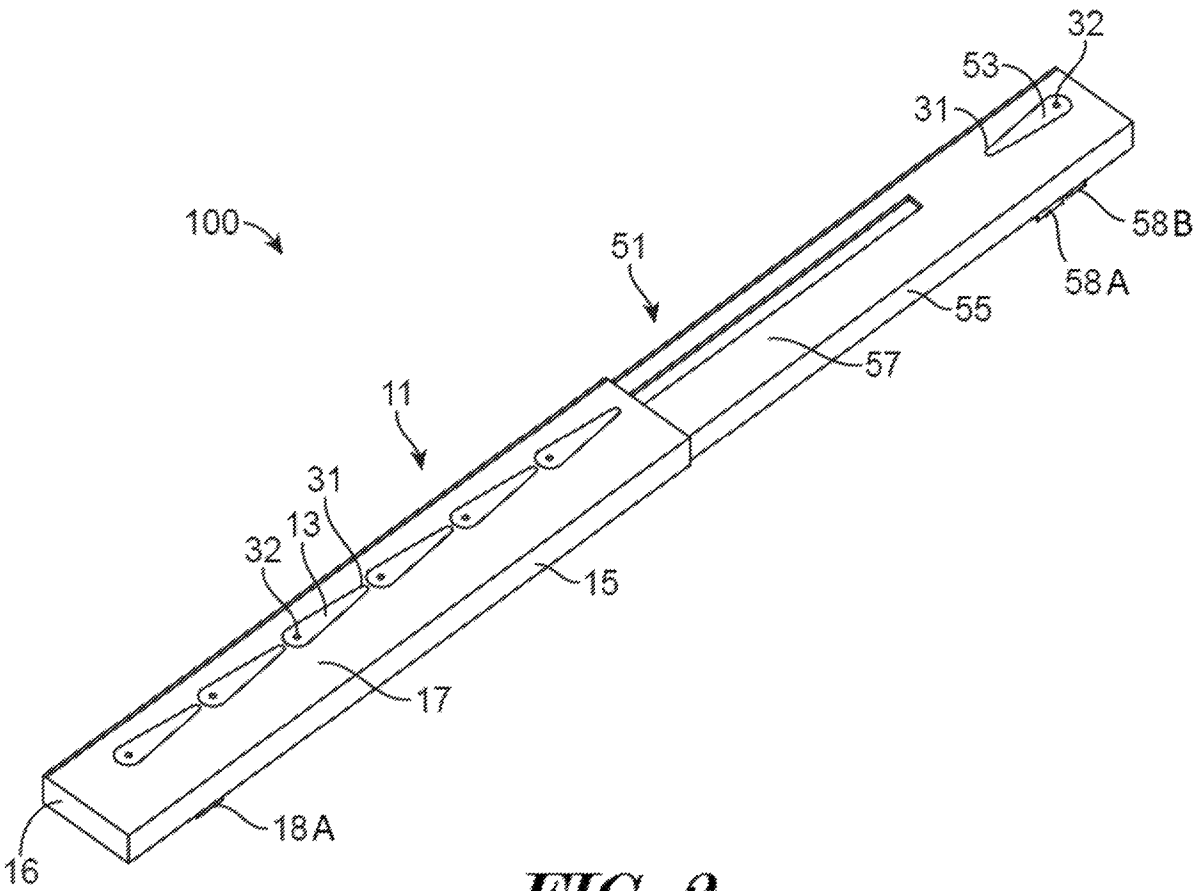
FIG. 2—FIG. 2 illustrates a rear perspective view of an example of a window treatment securement device according to various embodiments described herein.

The present invention will now be described by example and through referencing the appended figures representing preferred and alternative embodiments. FIGS. 1 and 2 illustrate an example of a window treatment securement device ("the device") 100 according to various embodiments. The device 100 may be used to secure window treatments 201 (FIGS. 8 and 9) to objects such as walls, window frames, window trim, doors, and other structural objects is provided. In some embodiments, the device 100 may include a first elongated member 11 having a first mounting plate 12. A first frame stake 13 may be coupled to the first elongated member 11, and a first receiving slot 14 may be coupled to the first mounting plate 12. The first elongated member 11 may optionally be coupled to a second elongated member 51 having a second mounting plate 52. A second frame stake 53 may be coupled to the second elongated member 51, and a second receiving slot 54 may be coupled to the second mounting plate 52. A window treatment 201 may be secured to one or more receiving slots 14, 54, of the device 100. The device 100 may be affixed an object, such as a wall 202 (FIG. 9) and/or window trim 203 (FIGS. 8 and 9), and the window treatment 201 may be secured to the device 100 thereby securing the window treatment 201 to the object.

In some embodiments, the first 11 and/or second 51 elongated member may comprise a generally rectangular prism shape as shown by FIGS. 1-9. The first elongated member 11 may comprise a first mounting plate 12 which may be coupled to one or more first major side plates 15 (FIGS. 1-7) and/or to one or more first minor side plates 16 (FIGS. 1-5, 7). The first elongated member 11 may also comprise a first support plate 17 (FIGS. 2, 6, 7, and 8). Optionally, the first major side plates 15, first minor side plate 16, and first support plate 17 may each comprise a generally flat planar rectangular shape so that when coupled together, the first elongated member 11 may be configured with a generally rectangular prism shape. Likewise, the second elongated member 51 may comprise a second mounting plate 52 which may be coupled to one or more second major side plates 55 (FIGS. 1-7) and/or to one or more second minor side plates 56 (FIGS. 1, 3-5, 7). The second elongated member 51 may also comprise a second support plate 57 (FIGS. 2, 6, 7, and 8). Optionally, the second major side plates 55, second minor side plate 56, and second support plate 57 may each comprise a generally flat planar rectangular shape so that when coupled together, the second elongated member 52 may be configured with a generally rectangular prism shape similar to the first elongated member 11.

In alternative embodiments, a first 11 and/or second 51 elongated member may be configured in any other shape and size. It should be understood to one of ordinary skill in the art that the first mounting plate 12, second mounting plate 52, and one or more optional first 15 and second 55 major side plates, optional first 16 and second 56 minor side plates, optional first 17 and second 57 support plates, and/or any other element mentioned herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

In some embodiments, the first 11 and second 51 elongated members may not be coupled together so that the first elongated member 11 and the second elongated member 51 may be moved or repositioned relative to each other. In some embodiments, the first 11 and second 51 elongated members may be coupled together in a fixed manner so that the first elongated member 11 and the second elongated member 51 may not be movable relative to each other. In preferred embodiments, the first 11 and second 51 elongated members may be movably coupled together so that portions of the first elongated member 11 may be moved relative to portions of the second elongated member 51 while the first 11 and second 51 elongated members are be coupled together. For example, a first elongated member 11 may be configured to be slightly larger than a second elongated member 51. The first elongated member 11 may also comprise a cavity 30 (FIG. 9) which may be complementary in shape to portions of the second elongated member 51 so that those portions of the second elongated member 51 may be inserted into and removed out of the cavity 30. In this manner, portions of the second elongated member 51 may be slidably received within the first elongated member 11, thereby allowing the length of the device 100 to be increased or decreased by extending or retracting one elongated member 11, 51, from the other elongated member 11, 51.

In alternative embodiments, the first 11 and second 51 elongated members may be removably coupled together so that portions of the first elongated member 11 may be moved relative to portions of the second elongated member 51 when uncoupled and then coupled together so that portions of the first 11 and second 51 elongated members may be maintained a desired distance from each other. For example, a first elongated member 11 and/or second elongated member 51 may comprise two or more fastener apertures which may be coupled together with removable fasteners such as nuts and bolts. By aligning different fastener apertures together and then coupling the first 11 and second 51 elongated members together with a removable fastener, the length of the device 100 to be increased or decreased.

In some embodiments and as shown in FIGS. 1, 3, 4, 6-9, a first elongated member 11 may comprise one or more first receiving slots 14 and/or a second elongated member 51 may comprise one or more second receiving slots 54. Generally, a receiving slot 14, 54, may comprise a space or recess into which portions of a window treatment 201 (FIGS. 8 and 9) may be inserted or wedged. A first receiving slot 14 may be bound and formed by a first retaining arm 18 (FIGS. 1, 3, 4, 7-9) which may be coupled to the first elongated member 11 such as to the first mounting plate 12. Optionally, portions of a window treatment, such as portions of a curtain rod bracket may be inserted or wedged into a first receiving slot 14 and secured between portions of the first retaining arm 18 and/or portions of the first mounting plate 12. In some embodiments and as shown in FIG. 1, a first elongated member 11 may comprise one or more first retaining arms 18A, 18B, 18C, 18D, etc. which may optionally form one or more first receiving slots 14 and/or which may comprise one or more first mounting apertures 19. Similarly, a second receiving slot 54 may be bound and formed by a second retaining arm 58 (FIGS. 1-4, 6, 8, 9) which may be coupled to the second elongated member 51 such as to the second mounting plate 52. Optionally, portions of a window treatment, such as portions of a curtain rod bracket, may be inserted or wedged into a second receiving slot 54 and secured between portions of the second retaining arm 58 and/or portions of the second mounting plate 52. In some embodiments and as shown in FIG. 1, a second elongated member 51 may comprise one or more second retaining arms 58A, 58B, 58C, 58D, etc. which may optionally form one or more second receiving slots 54 and/or which may comprise one or more second mounting apertures 59. In further embodiments, one or more retaining arms 18, 58, such as 18A, 18B, 18C, 18D, 58A, 58B, 58C, 58D, may be of various shapes and sizes. For example, one first retaining arm 18A may be larger than another retaining arm 18B or two retaining arms 18B and 58B may be a similar size and also be larger than retaining arms 18D and 58D.

Turning now to FIGS. 3-7, an alternative example of a window treatment securement device 100 according to various embodiments described herein is illustrated. In some embodiments, the device 100 may include a first elongated member 11 having a first mounting plate 12. A first frame stake 13 may be coupled to the first elongated member 11, and a first mounting aperture 19 may be positioned on the first mounting plate 12. The first elongated member 11 may be coupled to a second elongated member 51 having a second mounting plate 52. A second frame stake 53 may be coupled to the second elongated member 51, and a second mounting aperture 59 may be positioned on the second mounting plate 52. A window treatment 201 may be secured to one or more mounting apertures 19, 59, of the device 100. The device 100 may be affixed an object, such as a wall 202 (FIG. 9) and/or window trim 203 (FIGS. 8 and 9), and the window treatment 201 may be secured to the device 100 thereby securing the window treatment 201 to the object.

In some embodiments, the device 100 may comprise one or more receiving slots 14, 54, and/or one or more mounting apertures 19, 59, as shown in FIGS. 1, 3, 4, 6, and 7. For example, a first elongated member 11 may comprise one, two, three, four, five, six, or more first receiving slot 14, and/or one, two, three, four, five, six, or more first mounting apertures 19. In another example, a second elongated member 51 may comprise one, two, three, four, five, six, or more second receiving slot 54, and/or one, two, three, four, five, six, or more second mounting aperture 59.

Similar to receiving slots 14, 54, mounting apertures 19, 59, may be used to secure a window treatment 201 to the device 100 such as to the first 11 and second 51 elongated members. A mounting aperture 19, 59, may comprise a hole, recess, cut-out, or other opening into which portions of a window treatment 201 and/or a fastener 204 (FIGS. 8 and 9) may be inserted or received. For example, by inserting and tightening a screw-type fastener 204 through a portion of a window treatment 201 and a mounting aperture 19, 59, the portion of the window treatment 201 may be secured or attached to the device 100 by the fastener 204.

As perhaps best shown in FIGS. 2-7, and 9, the device 100 may comprise one or more first frame stakes 13 and/or one or more second frame stakes 53. For example, a first elongated member 11 may comprise one, two, three, four, five, six, or more first frame stakes 13, and/or a second elongated member 51 may comprise one, two, three, four, five, six, or more second frame stakes 53. A frame stake 13, 53, may comprise a generally flat planar formation of material which may be coupled to the first elongated member 11 or second elongated member 51. Optionally, a frame stake 13, 53, maybe coupled directly to a mounting plate 12, 52, or coupled to a mounting plate 12, 52, by being coupled to a major side plate 15, 55, minor side plate 16, 56, and/or support plate 17, 57, which is in turn coupled to the mounting plate 12, 52.

Figure 8:
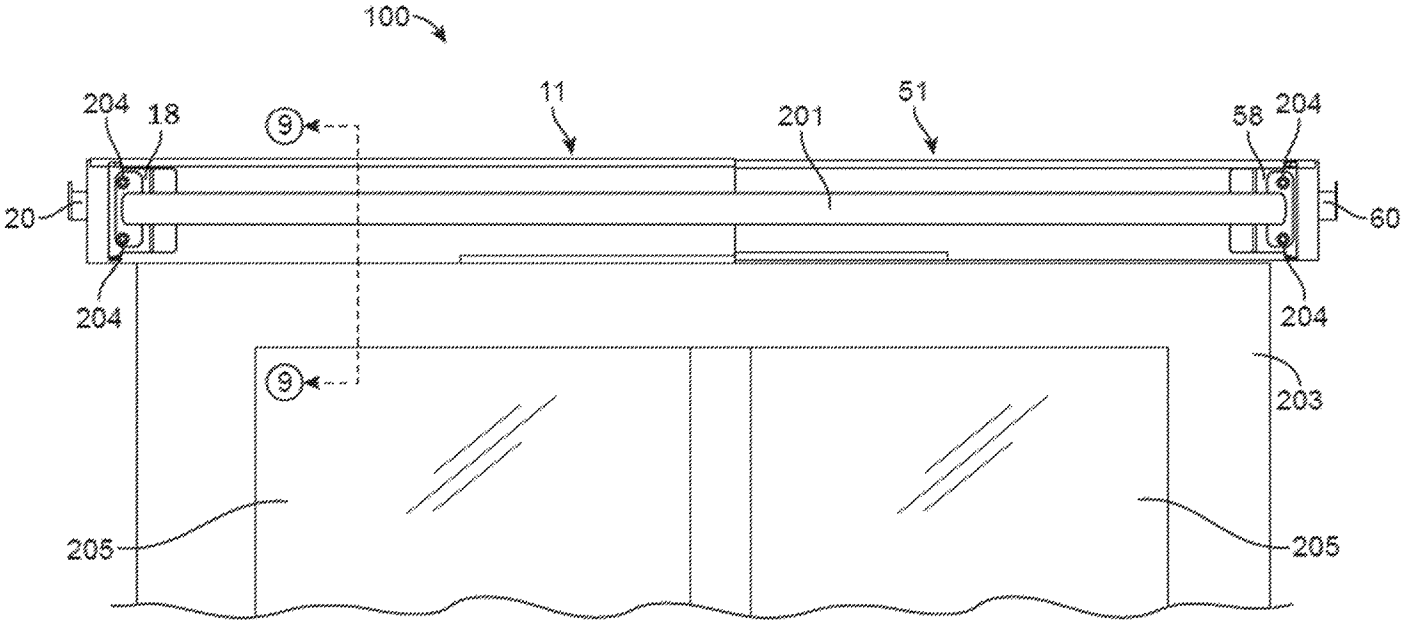
FIG. 8—FIG. 8 illustrates a perspective view of an example of a window treatment securement device which is affixed above a window and which is securing a window treatment according to various embodiments described herein.
Figure 9:
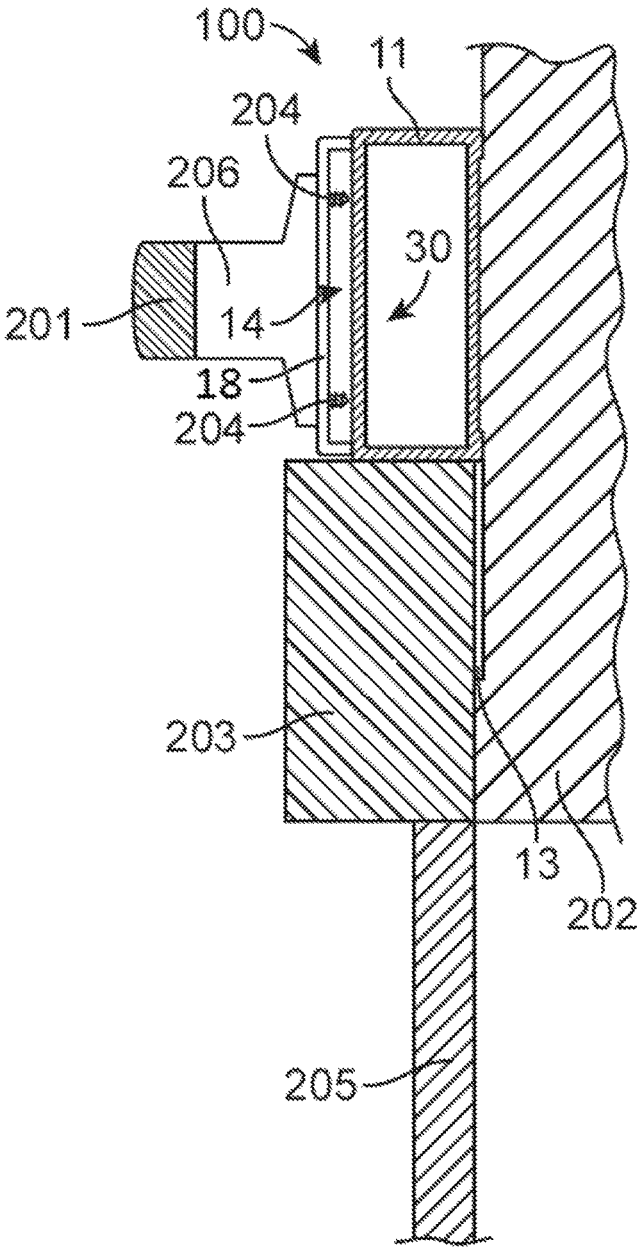
FIG. 9—FIG. 9 shows a sectional, through line 9-9 shown in FIG. 8, elevation view of an example of a window treatment securement device which is affixed above a window and which is securing a window treatment according to various embodiments described herein.

In preferred embodiments, a frame stake 13, 53, may comprise a tapered end 31 to facilitate the insertion of the frame stake 13, 53, between or into objects such as a wall 202 (FIG. 9) and window trim 203 (FIGS. 8 and 9). A tapered end 31 may be formed onto the end of the frame stake 13, 53, farthest from the portion of the frame stake 13, 53, that is coupled to an elongated member 11, 51. In some embodiments, a tapered end 31 may comprise a rounded shape which may form the farthest from the portion of the frame stake 13, 53, that is coupled to an elongated member 11, 51. In other embodiments, a tapered end 31 may comprise a pointed or blunt pointed shape, similar to the intersection of two sides of a triangle or rectangle, which may form the farthest from the portion of the frame stake 13, 53, that is coupled to an elongated member 11, 51. In still other embodiments, a tapered end 31 may comprise an angled shape and/or any other combination of shapes which may form the farthest from the portion of the frame stake 13, 53, that is coupled to an elongated member 11, 51, and which may facilitate the insertion of the frame stake 13, 53, between or into objects such as a wall 202 (FIG. 9) and window trim 203 (FIGS. 8 and 9).

In some embodiments, a frame stake 13, 53 may be fixedly or removably coupled to an elongated member 11, 51. In other embodiments a frame stake 13, 53 may be movably coupled to an elongated member 11, 51, so that portions of a frame stake 13, 53 may be moved relative to portions of an elongated member 11, 51. In preferred embodiments, a frame stake 13, 53 may be movably coupled to an elongated member 11, 51, so that the tapered end 31 of a frame stake 13, 53 may be moved relative to portions of an elongated member 11, 51.

As perhaps best shown in FIG. 1 and in some embodiments, a frame stake 13, 53, may be movably coupled to an elongated member 11, 51, with a pivotal coupling 32, thereby allowing the tapered end 31 of a frame stake 13, 53 to be pivoted towards, into contact with, away from, and/or out of contact with portions of an elongated member 11, 51. A pivotal coupling 32 may comprise a rivet, bearing, a pin joint, a pivot joint, a cotter joint, a bolted joint, a flexible material joint, a screw joint, or other pivoting fastening method which may be enable portions of a frame stake 13, 53 to be pivoted relative to an elongated member 11, 51.

Turning now to the example illustrated in FIGS. 3-7, in some embodiments, a frame stake 13, 53, may be movably coupled to an elongated member 11, 51, with a hinged coupling 33, thereby allowing the tapered end 31 of a frame stake 13, 53 to be moved towards, into contact with, away from, and/or out of contact with portions of an elongated member 11, 51. In preferred embodiments, a hinged coupling 33 may comprise a so-called "living" hinge, which typically comprises a linear, relatively flexible area between two relatively more rigid components, such as a line of thin plastic or flexible metal between thicker or more rigid portions, as is well known in the art. In other embodiments, a hinged coupling 33 may comprise a butt hinge, piano hinge, barrel hinge, butt/Mortise hinge, case hinge, flag hinge, strap hinge, H hinge, HL hinge, piano hinge, butterfly hinge, flush hinge, barrel hinge, concealed hinge, continuous hinge, T-hinge, strap hinge, double-acting hinge, Soss hinge, counterflap hinge, flush hinge, coach hinge, rising butt hinge, double action spring hinge, tee hinge, friction hinge, security hinge, cranked hinge or stormproof hinge, lift-off hinge, self closing or self positioning hinge, flexible material hinge, or any other type or style of hinge which may be enable portions of a frame stake 13, 53 to be moved relative to an elongated member 11, 51.

Referring now to FIGS. 3-8, in some embodiments, the device 100 may comprise one or more first bracket mating elements 20 and/or one or more second bracket mating elements 60. For example, a first elongated member 11 may comprise one, two, three, four, five, six, or more first bracket mating elements 20, and/or a second elongated member 51 may comprise one, two, three, four, five, six, or more second bracket mating elements 60. A bracket mating element 20, 60, may comprise a formation of material which may be shaped to engage with or otherwise be coupled to a window treatment 201 (FIGS. 8 and 9). Optionally, a bracket mating element 20, 60, maybe coupled directly to a mounting plate 12, 52, or coupled to a mounting plate 12, 52, by being coupled to a major side plate 15, 55, minor side plate 16, 56, and/or support plate 17, 57, which is in turn coupled to the mounting plate 12, 52.

Window treatments 201, such as curtain rods, are typically secured to surfaces and objects with one or more brackets, such as curtain rod brackets 206. These brackets 206 may be secured to a surface or object and then the curtain rod 201 may be coupled to one or more projections on the bracket 206. These projections are common in the art and may often further include one or more barbs or other minor projections. Portions of a curtain rod bracket projection may be inserted into a curtain rod 201 to support the curtain rod while portions of the barbs or other minor projections on the bracket may engage with the rod to prevent the rod from falling off of the bracket projections. In preferred embodiments, a bracket mating element 20, 60, may comprise or be formed into one or more projections, barbs 34, and/or minor projections, common to curtain rod brackets, which may be shaped to engage with portions of a window treatment 201, such as a curtain rod, thereby allowing the device to support and/or secure a window treatment without the use of a curtain rod bracket or the like. In further preferred embodiments and as depicted in FIGS. 8 and 9, a curtain rod bracket 206 may be secured to an elongated member 11, 51, with one or more fasteners 204 which may be inserted through the curtain rod bracket 206 and a mounting aperture 19, 59.

As perhaps best shown in FIGS. 8 and 9, a window treatment securement device 100 may be affixed to or above an object, such as a window 205, and may be used to secure a window treatment 201 to or above the object. In some embodiments, the device 100 may be secured to one or more objects by wedging or inserting one or more frame stakes 13, 53, into, between, or behind one or more objects. In the example of FIGS. 8 and 9, one or more frame stakes 13, 53, may be inserted or wedged between window trim 203, or a window frame which is proximate to a window 205, and the wall 202 to which the window trim 203 or window frame is coupled to. Optionally, portions of the device 100, such as the elongated members 11, 51, may be supported by the window trim 203 or window frame while the frame stakes 13, 53, secure the device 100 to the window trim 203 or window frame proximate to the window 205.

In alternative embodiments, the device 100 may be secured to one or more objects, such as a wall 202, window trim 203 or window frame, door, or any other surface or structure, with adhesive, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function.

While some materials have been provided, in other embodiments, the elements that comprise the device 100 such as the first elongated member 11, first mounting plate 12, first frame stake 13, second elongated member 51, second mounting plate 52, second frame stake 53, optional receiving slots 14, 54, optional mounting apertures 19, 59, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A window treatment securement device for mounting above a window trim, the device comprising:

a first elongated member comprising a first mounting plate on a front side, a first support plate on a rear side, a top side major side plate on a top side, and a bottom side major side plate on a bottom side, a distal end minor side plate and a medial end minor side plate, said first mounting plate, first support plate, top side major side plate, bottom side major side plate, distal end minor side plate, and medial end minor side plate all forming a rectangular prism shape where there is a first right angle connection between the first support plate and the bottom side major side plate;

a first plurality of frame stakes coupled to the first elongated member and protruding below said first right angle connection between the first support plate and the bottom side major side plate, and the first plurality of frame stakes configured to be wedged behind the window trim while the bottom side major side plate is resting on top of the window trim;

a first receiving slot coupled to the first mounting plate and configured to secure a window treatment above the window trim and at a position above the bottom side major side plate;

a second elongated member comprising a second mounting plate;

a second plurality of frame stakes coupled to the second elongated member; and a second receiving slot coupled to the second mounting plate and configured to secure the window treatment above the window trim.

2. The device of claim 1, wherein the first elongated member comprises a first mounting aperture, and wherein the second elongated member comprises a second mounting aperture.

3. The device of claim 1, wherein the second elongated member is movably coupled to the first elongated member.

4. The device of claim 3, wherein portions of the second elongated member may be slidably received within the first elongated member.

5. The device of claim 1, wherein the a first frame stake of the first plurality of frame stakes comprises a tapered end.

6. The device of claim 1, wherein the first elongated member comprises a first bracket mating element, and wherein the second elongated member comprises a second bracket mating element.

7. The device of claim 1, wherein the distal end minor side plate of the first elongated member comprises a first bracket mating element.

8. The device of claim 7, wherein the first bracket mating element comprises a first barb for securing a curtain rod bracket.

9. The device of claim 1, wherein the first plurality of frame stakes are located at positions more proximate to the distal end minor side plate than to the medial end minor side plate.

* * * * *